United States Patent [19]

Camenisch

[11] 4,017,131

[45] Apr. 12, 1977

[54] MAXIMUM DENSITY MOBILE STORAGE SYSTEM

[75] Inventor: Johann L. Camenisch, Dubendorf, Switzerland

[73] Assignee: J. Gestle, AG, Chur, Switzerland

[22] Filed: Sept. 22, 1970

[21] Appl. No.: 74,287

[52] U.S. Cl. ..... 312/198; 312/201; 214/16 B; 104/147 R

[51] Int. Cl.[2] ..... A47B 53/00

[58] Field of Search ..... 312/199, 200, 198, 201; 104/178, 147 R; 214/16.1 CC, 16 B

[56] References Cited

UNITED STATES PATENTS

| | | | |
|---|---|---|---|
| 1,829,023 | 10/1931 | Swartout | 214/16.1 CC |
| 2,605,911 | 8/1952 | Medway | 214/16.1 CC |
| 2,617,546 | 11/1952 | Rosener | 214/44 R |
| 3,198,592 | 8/1965 | Zippel | 104/178 X |
| 3,482,089 | 12/1969 | Raffel et al. | 105/61 R |
| 3,563,400 | 2/1971 | Greaves | 214/16.1 CC |
| 3,566,802 | 3/1971 | Lundgvist | 312/199 |
| 3,575,479 | 4/1971 | Kombuchen | 312/200 |
| 3,640,595 | 2/1972 | Staller et al. | 312/198 |

FOREIGN PATENTS OR APPLICATIONS

| | | | |
|---|---|---|---|
| 1,557,743 | 1/1969 | France | 104/162 |
| 1,807,902 | 6/1969 | Germany | 312/200 |

*Primary Examiner*—Frank E. Werner
*Assistant Examiner*—R. B. Johnson
*Attorney, Agent, or Firm*—Harness, Dickey & Pierce

[57] ABSTRACT

A maximum density mobile storage system in which groups of racks or other storage devices are arranged side by side in a row or bay along side a loading and unloading aisle or corridor, the individual racks being selectively movable individually or in groups so as to leave a loading or unloading space between any two of the racks, whereby the length of the bay need exceed the sum of the widths of the racks by an amount which equals the width of the desired gap, particularly characterized in that the width of the gap can be varied simply by altering the position of end stops which determine the overall limits of travel of the racks; any moving rack can be stopped at any point at any time therefore enabling the establishment of multiple gaps; the racks are individually motored and the controls are such that when the system is placed in motion the racks remain in motion until all gaps in the moving direction have been filled or closed; individual controls can be carried by the associated racks or centrally positioned; directional priority is provided to determine the direction in which an individual rack will move in the event gaps exist both before and aft of its position in the row.

4 Claims, 8 Drawing Figures

FIG. 1.
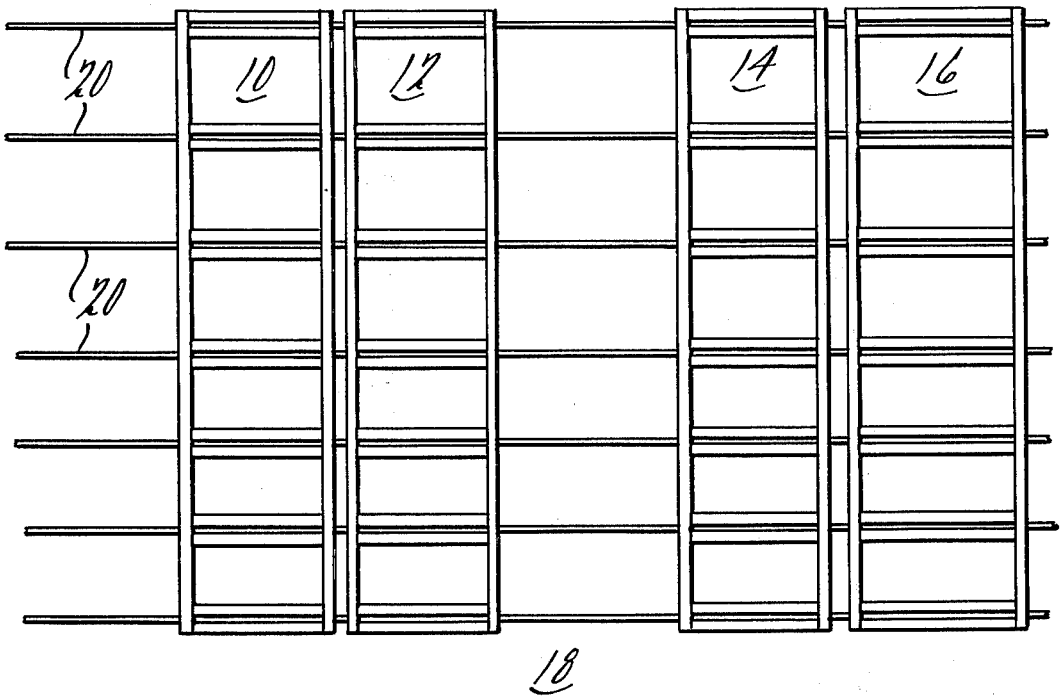
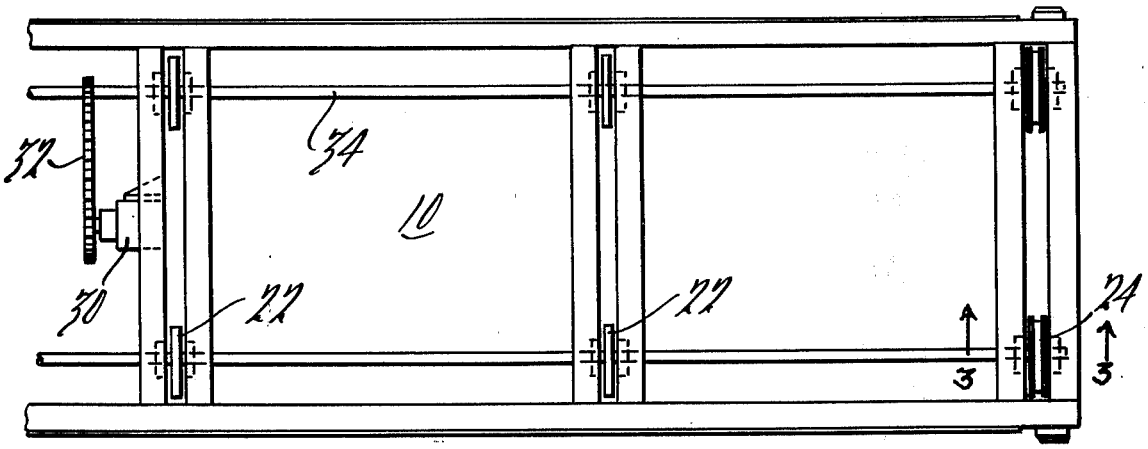
FIG. 2.
INVENTOR.
Johann L. Camenisch.
BY
Harness, Dickey & Pierce
ATTORNEYS.

INVENTOR.
Johann L. Camerisch.
BY
Harness, Dickey & Pierce
ATTORNEYS.

INVENTOR.
Johann L. Camenisch
BY
Harness, Dickey & Pierce
ATTORNEYS

INVENTOR.
Johann L. Camenisch
BY
Harness, Dickey & Pierce
ATTORNEYS

MAXIMUM DENSITY MOBILE STORAGE SYSTEM

BACKGROUND OF THE INVENTION

Maximum density mobile storage systems are known in which, as aforesaid, groups of racks are arranged for movement along a bay so as to define a load or unloading gap or space between any two of the racks. So far as the present applicant is aware however, the known system have certain disadvantages which are overcome in the practice of the present invention. More particularly, in certain of these systems control of the movements of the individual racks is governed by segmental bus bars located along the path of travel of the racks and the lengths of the loading or unloading gaps is determined by the length of these bus bars. With such a system change in the length of this gap or space requires changing the lengths of individual bus bars. In others of these systems if, due to different load conditions, or the like, one or more of several moving racks tends to get ahead of some or all of the others, several starting operations may be needed in order to fill up all the thus produced small gaps which, in the moving direction, are beyond the gap or space which is desired to establish.

In accordance with the present invention sensing means are provided which sense the existence of one or a plurality of gaps. If it is desired to establish a gap at a selected side of a selected rack, that rack is started and the sensing mechanism causes that rack and all others ahead of it in the moving direction to continue in motion until all gaps in the moving direction (between racks as well as between the end rack and the end of the bay) are closed, at which time the maximum gap has been established at the selected side of the selected rack and all moving racks are stopped. The length of the bay and consequently the width of the maximum gap can be readily changed simply by moving switch operating means which sense the arrival of the end racks at the corresponding ends of the bay.

Accordingly, objects of the invention are to provide a mobile storage or other system comprising a plurality of movable racks or other load carrying devices in which the width of one or more gaps or spaces between the devices can be varied simply by altering the position of instrumentalities which determine the ends of the bay or other area with which the devices are associated; to provide such a system in which, when placed in motion, the racks in the moving direction remain in motion until all gaps in that direction have been filled or closed; to provide such a system in which the devices are individually controlled and so may be stopped at any time thereby enabling the establishment of one or more gaps in the system; to provide such a system in which controls individual to the several devices may be carried thereon or may be centrally located; to provide such a system having directional priority so as to determine which direction a selected rack tends to move in the event gaps exist on either side thereof; to provide such a system incorporating sensing means to sense the existence of gaps at either side of a selected rack, whereby in the event that rack is started in a selected direction all gaps ahead of it in that direction will be filled before the devices are stopped; and to generally improve and simplify the operation of mobile storage and related systems. Other objects and advantages of the present invention will become apparent from the following detailed description taken in conjunction with the accompanying drawings.

BRIEF DESCRIPTION OF THE DRAWINGS

FIG. 1 is a somewhat diagrammatic view of an illustrative mobile storage rack system which may incorporate the present invention;

FIG. 2 is a fragmentary top plan view of the base structure of one of the racks of FIG. 1 illustrating the supporting and driving mechanism therefor;

FIGS. 6 and 7 are circuit diagrams illustrating stationary control equipment which is common to all of the racks of the system and the individual controls which are carried by the individual racks;

Figure 8:
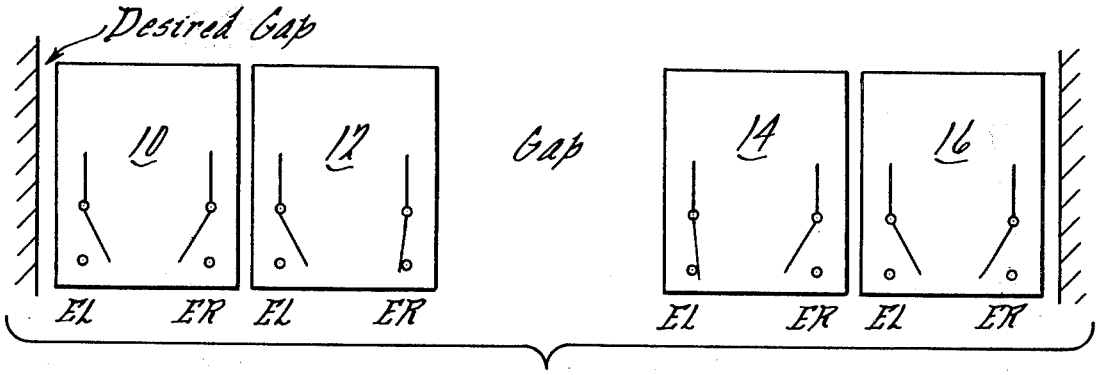

and,

FIG. 8 is a diagrammatic view showing the position of the cam operated switches under a selected operating condition.

DETAILED DESCRIPTION OF A PREFERRED EMBODIMENT

Referring first to FIGS. 1 through 4, the present system, though applicable to any desired number of racks or other mobile load carrying devices is illustrated as comprising a series of four storage racks 10, 12, 14 and 16. These racks may be of any well-known type, for example pallet racks or cantilever racks. They are positioned in side-by-side relation for limited travel to the right or to the left along one side of a loading or unloading aisle. The limits of travel are determined by end stops 42, described in more detail below. The individual racks are illustrated as supported upon and for guided movement along tracks 20, by means of rollers 22 and 24, although any desired means, including air bearings or the like may be used to support the racks for movement lengthwise of the row or bay. Rollers 22 ride in slots (not shown in detail) in the supporting floor or other structure of the associated warehouse or other space. To give additional support to the associated rack, the rollers 24 are flanged and span rails 26 located in channels 28 provided in the associated floor. Each rack is illustrated as having a drive motor 30 individual thereto which, as through a chain 32, drives an associated shaft 34. One or more of the supporting rollers, such as 22 and 24, is or are drivingly connected to the shaft 34 and, consequently, rotation of the motor in either a forward or reverse direction drives the associated rack in the corresponding direction.

Figure 3:
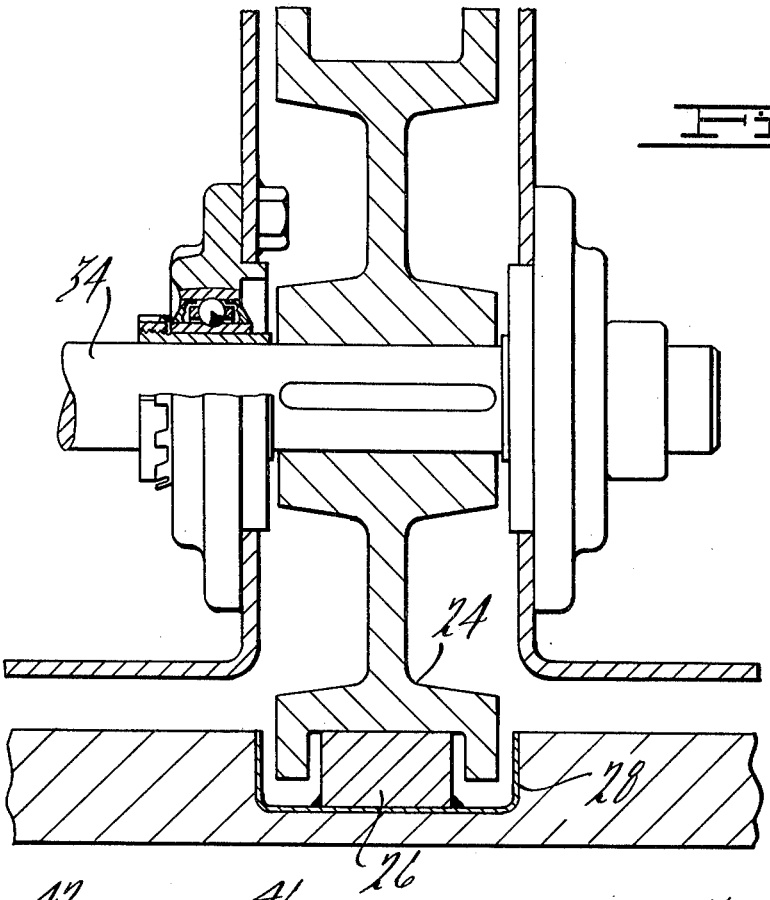
FIG. 3 is a detailed view taken along the line 3—3 of FIG. 2.
Figure 4:
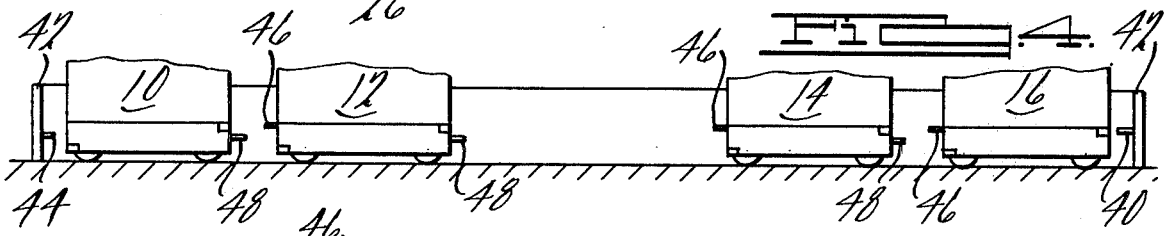
FIG. 4 is a diagrammatic view in side elevation of the rack system of FIG. 1.
Figure 5:
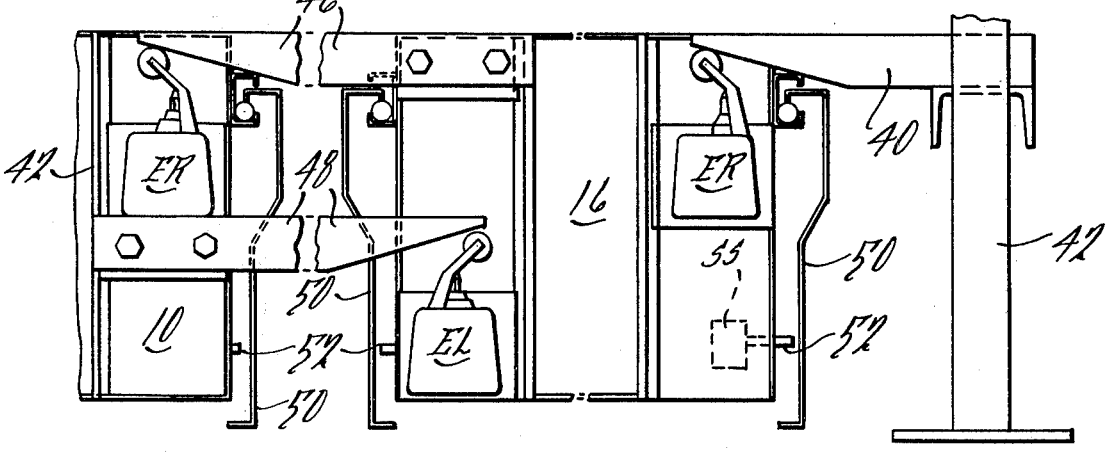
FIG. 5 is a diagrammatic view based upon the right hand portion of FIG. 4 and showing the arrangement of cam operated switches, and operating cams therefor.
Figure 3:
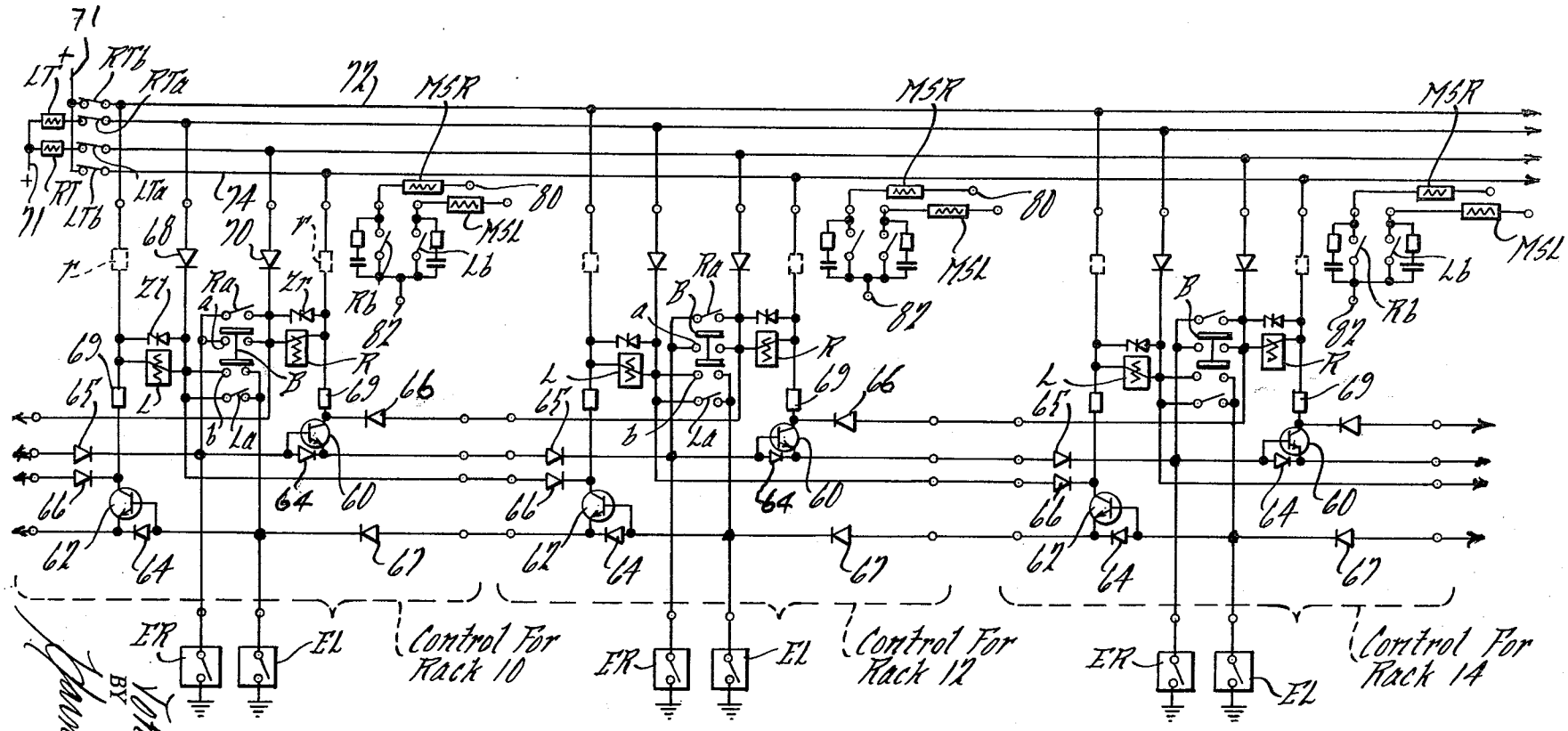

Referring now particularly to FIGS. 4 and 5, each rack in the system carries a pair of well known cam operated switches EL and ER. Except when actuated by their associated operating cams, described below, the contacts of the limit switches ER and EL are closed. Each switch carries an operating arm, which, when engaged and depressed by an associated cam, moves the associated contacts to the open position and retains them there until the switch and cam are separated at which time the contacts reclose.

As seen in both FIGS. 4 and 5, the limit switch ER for the right-hand end rack, No. 16, is arranged for operation by a cam 40 carried by an upright 42. Similarly, as appears in FIG. 4, an upright 42 in the left-hand end of the bay carries a cam 44 which, in the manner indicated for cam 40, engages and opens the switch EL for the left-hand rack as the latter reaches the left-hand limits position. It will thus be seen that cams 40 and 44 determine the overall length of the path of travel of the racks, and this path of travel may be altered simply by relocating one or both of cams 40 and 44, thereby enabling changes in length of the loading and unloading gap or gaps provided by this system, as well as enabling a number of racks in a given system to be changed at will.

Racks 10, 12 and 14 each carry cams 48 which can engage and open the limit switches EL for, respectively, racks 12, 14 and 16 as these racks reach positions adjacent each other. Similarly, racks 12, 14 and 16 carry cams 46, which can engage and operate the switches ER associated respectively with racks 10, 12 and 14 when these racks are adjacent each other.

Before proceeding with the description of the electrical control system of the present invention, it is noted that each rack carries a pair of pivoted switch operating arms 50, the lower ends of which can be swung towards the associated rack, either manually or in the event the associated rack encounters some obstacle to its movement. Each rack also carries a pair of normally closed stopping switches SS, one of which is shown in FIG. 5 in connection with rack 16. Each stopping switch SS carries a plunger 52 which projects outwardly toward but is normally spaced from the associated switch operating arm 50. If the associated arm 50 is depressed, arm 52 opens the associated switch. As hereinafter described opening of any switch SS in the system immediately stops all of the racks then in operation and resets the system so that further motion can be initiated only by repeating the normal starting operation.

Figure 7:
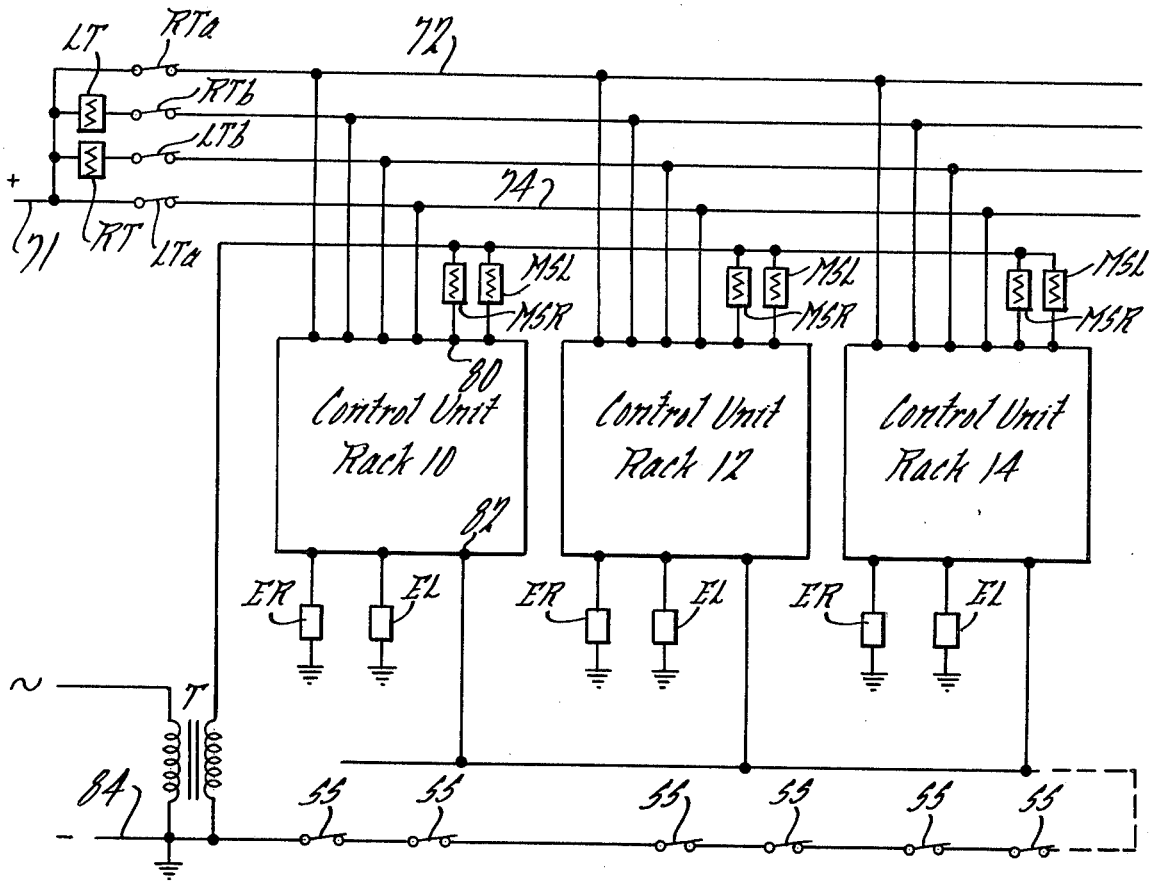

Referring now to FIGS. 6 and 7, each rack is provided with a control unit, so designated, and all control units are identical. To simplify the drawing the controls for only three racks 10, 12 and 14, are shown. Additional controls can be added at either end, as is indicated by the arrow-headed conductors shown at the respective ends of FIG. 6. Each rack is provided with a starting device herein illustrated as a manually operated pushbutton B, provided with two pairs of normally open contacts B*a* and B*b*. As illustrated, the individual starting switches B are carried by the associated rack. It will be understood that if desired they may all be located at a central control point. Each individual control also includes a pair of usual electromagnetic relays R and L. Each relay R is provided with a normally open self-holding contact R*a* and a motor starting contact R*b*. Similarly, each relay L is provided with normally open self-holding and motor starting contacts L*a* and L*b*.

Additionally, each control unit is provided with usual transistors 60 and 62, and control diodes 64, 65, 66 and 67, the action of which is described below. The energizing circuits for the directional relays RL may include rather widely differing numbers of the control diodes 64, 65, 66 and 67, depending upon how many racks are required to be moved in order to establish a new gap or space and fill up an existing space or spaces. These individual control diodes are low in resistance compared to the resistances of the coils of relays R and L. Nevertheless, it is preferred to connect zener diodes Z*r* and Z*l* in parallel with the coils of relays R and L so as to limit the voltages applied to these coils. Similarly, to limit current flow in the relay circuits, protective resistors are preferably provided.

Diodes 68 and 70 and resistors 69 are provided for usual protective purposes.

In order to provide directional interlocking or directional priority, the system also includes a pair of directional relays LT and RT. As described below, as an incident to an initiation of a rightward movement of one or more of the racks, the directional relay RT is energized. This action opens its two normally closed contacts RT*a* and RT*b*. The opening of contact RT*a* prevents completion of a circuit for relay LT and the opening of contact RT*b* disconnects feeder bus 72 from the illustrated direct voltage source 71. Bus 72 feeds all of the circuits involved in leftward motions of the racks, and de-energization thereof therefore prevents completion of any circuits involved in leftward motion of the rack. Similarly, energization of relay LT which occurs as an incident to the initiation of the leftward movement of any one or more of the racks, opens its contacts LT*a* and LT*b*, thereby locking out the rightward relay RT and disabling the rightward feeder bus 74.

It is believed that the remaining details of the system can best be understood from a description of typical operating sequences thereof. As an initial example, and referring to FIG. 8, it may be assumed that racks 10 and 12 are adjacent each other and are located at the left-hand end of the associated bay. Similarly, racks 14 and 16 are in engagement with each other and are located at the right-hand end of the associated bay leaving a gap or space between racks 12 and 14. Under these conditions switches EL of racks 10, 12 and 16 are open and switches ER of racks 10, 14 and 16 are open. However, switch ER of rack 12 and switch EL of rack 14 are closed since the operating cams associated therewith are not adjacent thereto.

Assuming now that it is desired to establish a loading or unloading gap or space between rack 10 and the left-hand end of the storage bay, the starting switch B associated with rack 10 may be moved to the closed position, closing its contacts B*a* and B*b*. Closure of contacts B*a* completes an energizing circuit for the coil of directional relay RT extending from the positive side 71 of direct voltage souce 71–84, through coil RT, now closed contact LT*a*, protective diode 70, contact B*a* and thence through control diodes 64 and 65, of respectively racks 10 and 12, and thence to ground through the now closed switch ER associated with rack 12. Closure contact B*b* is without effect since under the conditions sets switch EL, associated with rack 10 is open, and control diode 64 associated with rack 10 has no connection to ground.

Upon being energized directional relay RT opens its contacts RT*a* and RT*b*, thereby preventing energization of any circuits associated with leftward travel of the racks.

Closure of contact B*a* of starting switch B also completes an energizing circuit for the coil of relay R, extending from the positive side 71 of the source through now closed interlock contact LT*b*, supply bus 74, current limiting resistor *r*, the coil of relay R, contacts B*a* and thence to ground through control diodes 64 and 65 associated with respectively the racks 10 and 12 and the now closed switch ER associated with rack 12.

Upon completion of this circuit relay, R closes its contacts R*a* and R*b*. Contact R*a* completes a self-holding circuit for the coils of relays R and RT so that switch B may now be released without effect upon the operation now being described. Closure of contacts R*b*, which are connected in parallel with a usual arc suppressing network, interconnects terminals 80 and 82 of the control unit associated with rack 10. As appears in FIG. 7 this action connects the winding of motor starting switch MSR associated with rack 10 across the direct voltage source 71–84.

More particularly, in FIG. 7, the secondary winding of a step down transformer T supplies energizing current for the coil of switch MSR through an obvious circuit which also includes in series all of the previously described switches SS for all of the racks in the system. It will be understood that, upon being energized switch MSR completes in any well known manner energizing circuits (not shown) which cause motor 30 to drive rack 10 to the right.

In addition to the foregoing operations, the flow of current through control diode 64 associated with transistor 60 of the control unit for rack 10 establishes a potential drop between the base and the emitter of transistor 60 of sufficient value to cause this transistor to become conductive.

Before describing the effect of transistor 60, it is noted that under the conditions stated the voltage of the source 71–84 is divided between resistor *r*, the coil of relay R and one pair of diodes 64 and 65. If more than one rack lay between rack 10 and the gap to filled, this circuit would include a corresponding number of additional pairs of diodes 64 and 65. More particularly, if the existing gap lay between racks 14 and 16, this circuit would include an additional pair of diodes 64 and 65 associated, respectively, with the controls for racks 12 and 14, since in this case the first closed limit switch ER to the right of rack 10 would be the switch ER for rack 14. However, as aforesaid the resistances of diodes 64 and 65 are low in relation to the resistance of coil R. Also, the current voltage characteristic of the illustrated control diodes is such that under all operating conditions the potential drops thereacross, and applied thereby to the associated transistors remains fairly constant and of a value above the critical value required to cause the transistors to conduct.

Upon becoming conductive transistor 60 associated with the control unit for rack 10 completes an energizing circuit for the relay R associated with the control unit for rack 12. This circuit extends through the enclosed interlocking contact LT*b*, supply bus 74, protective resistor *r*, the coil of relay R associated with rack 12, diode 66, transistor 60 and thence to ground through diode 65 and switch ER of the control unit associated with rack 12. Upon being energized relay R associated with rack 12 acts as did relay R associated with rack 10. More particularly, it closes its contact R*a* thereby completing a self-holding circuit for itself which extends to ground directly through the associated switch ER. Through closure of its contacts R*b* this relay R also completes energizing circuits for its associated motor starting switch MSR which in turn completes a rightward starting circuit (not shown) for the drive motor associated with rack 12.

In perhaps the majority of cases it may be assumed that racks 10 and 12 will proceed at the same rate and that, consequently, no changes in operating circuitry will occur until their rightward movement has progressed far enough to close the gap between racks 12 and 14. Under some conditions however such as in the event of a wide disparity between the loads on racks 10 and 12, rack 12 might tend to pull ahead of rack 10. If it should do so, switch ER of rack 10 and switch EL of rack 12 would close. Switch ER of rack 10 is in parallel with transistor 60 of rack 10 and diode 65 of rack 12, and closure thereof disables the original energizing circuits for relays R of racks 10 and 12. This is without effect, since the energizing circuits for these relays R are now completed directly through the associated switches ER. Closure of switch EL of rack 12 is without effect. Consequently, under the conditions stated, both racks 10 and 12 continue in motion to the right. When rack 12 has closed the gap between it and rack 14, the operating arm of switch ER associated with rack 12 encounters the operating cam carried by rack 14 and is moved thereby to the open position.

Assuming rack 10 and 12 are traveling together, i.e., that rack 12 has not pulled ahead of rack 10, opening of switch ER of rack 12 interrupts the energizing circuits for relays R of both racks 10 and 12 and for the directional relay RT. This resets all circuits to the initial condition and stops the motors for both racks 10 and 12.

If, on the other hand, rack 12 had pulled ahead of rack 10, the reopening of switch ER for rack 12 would stop that rack and reset its circuits to the original condition, but would not deenergize relay R for rack 10 or directional relay RT. When however, rack 10 caught up to now-stopped rack 12, its switch ER would open, thereby deenergizing its relay R and directional relay RT and stopping this rack and resetting its circuits.

It will be understood that the rack drive motors may be and preferrably are of the type which incorporate brakes which automatically release when the motors are started and automatically set themselves when the motor is disconnected from the line.

It is believed to be evident that had it been desired to establish the gap between racks 10 and 12, the operator would have closed the starting switch B associated with rack 12. This would have energized the directional RT ad the rightward control relay R associated with rack 12, in a manner obvious from previous description. As before, closure of contacts R*a* would have completed maintaining circuits for relays RT and R and would cause rack 12 to start and move to the right. In this case, the energizing circuits for relays RT and R proceed directly through ER rather than through the previously mentioned control diodes 64 and 65 associated with racks 10 and 12. Stoppage of rack 12 would occur in the previously described manner. As rack 12 moved away from rack 10, switch ER for rack 10 would close. This would be without effect, since button B for rack 10 would be open.

As will be obvious from FIG. 7, opening of any switch SS interrupts all energizing circuits and stops all moving racks. This might occur at a time when several gaps exist in the system. For example, it may be assumed that gaps exist between racks 10 and 12, and between racks 12 and 14, and that it is desired to establish a gap to the left of rack 10. In this instance, switches ER for both of racks 10 and 12 are closed. Closure of button B for rack 10 again completes energizing and maintaining circuits for relay RT and relay R of rack 10, directly through switch ER of rack 10. Being directly in parallel with diodes 64 and 65 of respectively racks 10 and 12, switch ER of rack 10 prevents appearance of a voltage between the base and emitter of transistor 60 of rack 10, and so prevents energizing relay R of rack 12. Thus, only rack 10 starts. When rack 10 reaches rack 12, switch ER of rack 10 opens. This action opens the initial circuits for relays RT and R of rack 10 but causes immediate re-routing thereof through diodes 64 and 65, and switch ER of rack 12. As in the first example also, firing of transistor 60 energizes relay R of rack 12. Consequently, after closure of the gap between racks 10 and 12, both racks travel to the right until the gap ahead of rack 12 is closed. If at this time a further gap existed in the system to the right of rack 14, e.g., between rack 16 and the end of the bay, its presence would be sensed by now closed switch ER for rack 16 and in the just described manner, the system would continue in operation until racks 12, 14 and 16 were together and rack 16 was at the end of the bay. It will be obvious also, that simply by moving the limit switches which define the ends of the bay, the effective length thereof is changed. For a given number of racks in a bay, this permits the gap size to be readily changed. It also permits the number of racks in a bay to be increased or decreased at will.

The circuits involved in leftward travel of the racks are in all substantial respects the same as those involved in rightward travel and do not require detailed explanation. It may however be briefly noted that if it is desired to establish a gap between racks 14 and 16, the switch B associated with rack 14 may be closed. This action energizes the leftward directional relay LT which thereupon opens its contacts LT*a* and LT*b* and locks out all rightward circuits. Closure of contact B*b* of switch B for rack 14 also completes an energizing circuit for the leftward control relay L which extends through the now closed switch EL associated with rack 14 to ground. Upon being energized relay L completes self-holding and maintaining circuits for itself and relay LT and also energizes the associated leftward starting switch MSL, which as will be obvious from previous description cuases the associated motor 30 to drive rack 14 to the left. When rack 14 encounters rack 12 switch EL associated with rack 14 and switch ER associated with rack 12 both open. The opening of switch ER for rack 12 is without effect but the opening of switch EL for rack 14 stops this rack in the previously described manner.

It is believed to be obvious that if it had been desired to establish a gap between racks 14 and 16, at a time when the existing gap was between racks 10 and 12, closure of switch B for rack 14 would have completed starting circuits for both racks 14 and 12. More particularly, the closure of switch B for rack 14, would energize relay L for rack 14 (and relay LT) through diodes 64 and 67 for racks 14 and 12 respectively and switch EL for rack 12. Current flow through diode 64 fires transistor 62 for rack 14 and this action energizes relay L for rack 12 through associated diode 66, diode 67 of rack 12 and switch EL of rack 12. As before, the racks would proceed to the left until all gaps to the left of rack 14 had been closed.

In some instances, it may be desired to move a rack at a time when gaps exist at both sides thereof. This is provided for in the present structure, in which each rack carries only a single starting switch, by introducing time delay characteristics within the switch B, as for example causing contact *a* to close before *b*.

Although only a single embodiment of the invention has been described in detail, it will be appreciated that various modifications in the form, number and arrangement of parts may be made without departing from the invention.

What is claimed is:

1. A mobile load carrying system comprising an elongated supporting structure having end stops, a plurality of load carrying devices mounted on said supporting structure in side-by-side relation for movement along a controlled path between said end stops, the length of said path exceeding by a predetermined amount the sum of the widths of the devices whereby to provide at least one loading or unloading gap between selected ones of the devices, a plurality of motive means, each motive means being carried by an individual device, all of said motive means being separate from said supporting structure, sensing means carried by each device on opposite sides thereof for sensing the presence or absence of a gap between either side of said device and an adjacent device or one of said end stops, each sensing means comprising a switch shiftable between a first position when a gap is present and a second position when a gap is absent, means for controlling the motive means of and thereby starting a selected device having both switches in said second position towards a gap and simultaneously energizing the individual motive means of and thereby starting all other devices between said selected device and said gap until the gap is closed, the movement of said devices being in unison, said energizing means including a circuit between a power source and a switch on one of said devices which is in said first position, and means responsive to a change in the current in said circuit simultaneously to activate the motive means of said selected device as well as said other devices while the switches of said selected device are both still in their second position.

2. The combination according to claim 1, said end stops being adjustable to thereby determine the overall length of said path.

3. The combination according to claim 1, said control means including means responsive to the pulling ahead of one device from another traveling therewith for maintaining the motion of both devices.

4. The combination according to claim 1, said control means including means on each device responsive to sensing the arrival of another device from one side to move in unison with said device toward a gap on the other side.

* * * * *